US005931565A

United States Patent [19]

Flanagan, Jr. et al.

[11] Patent Number: 5,931,565

[45] Date of Patent: Aug. 3, 1999

[54] TUBULAR LAMP AND REFLECTOR WITH TWO FLEXIBLY COUPLED SECTIONS

[75] Inventors: Robert W. Flanagan, Jr., Weare; Roman Milikovsky, Bedford; Charles M. Coushaine, Rindge, all of N.H.

[73] Assignee: Osram Sylvania Inc., Danvers, Mass.

[21] Appl. No.: 08/887,013

[22] Filed: Jul. 2, 1997

[51] Int. Cl.[6] ..... F21M 3/14

[52] U.S. Cl. ..... 362/255; 362/256; 362/310; 362/298

[58] Field of Search ..... 362/223, 255, 362/256, 310, 298, 346, 219, 297

[56] References Cited

U.S. PATENT DOCUMENTS

| | | | |
|---|---|---|---|
| 2,595,771 | 5/1952 | Curzon | 362/223 |
| 4,966,014 | 10/1990 | Erickson | 62/235 |
| 5,645,337 | 7/1997 | Gleckman | 362/29 |
| 5,716,123 | 2/1998 | Lamming | 362/222 |
| 5,735,595 | 4/1998 | Nederpel | 362/223 |

*Primary Examiner*—Sandra O'Shea
*Assistant Examiner*—Marshall Honeyman
*Attorney, Agent, or Firm*—William E. Meyer

[57] ABSTRACT

A lamp assembly includes a lamp capsule having a tubular lamp envelope, and a reflector disposed around the lamp envelope. The reflector defines an aperture for emission of light from the lamp capsule. The reflector has a reflecting surface facing the lamp envelope. The aperture has a dimension transverse to the longitudinal axis of the lamp envelope that is less than the diameter of the lamp envelope. The reflecting surface preferably has a diffuse reflecting characteristic. The lamp capsule may be a low pressure discharge lamp, such as a neon lamp. The lamp assembly may, for example, be used as a center high mount stop light in a vehicle.

28 Claims, 6 Drawing Sheets

TUBULAR LAMP AND REFLECTOR WITH TWO FLEXIBLY COUPLED SECTIONS

FIELD OF THE INVENTION

This invention relates to lamp assemblies that include tubular lamps and, more particularly, to lamp assemblies having an aperture for directing light emitted by a tubular lamp in a preferred direction. The lamp assemblies are particularly useful in vehicles, but are not limited to this use.

BACKGROUND OF THE INVENTION

It has become customary in automobiles, sport utility vehicles and other vehicles to utilize a stop/brake light which is located high on the rear of the vehicle and is centered for improved visibility. The stop light is commonly known as a center high mount stop light (CHMSL). The stop light may, for example, be located in the rear window. In sport utility vehicles which have a tailgate, the stop light may be located above the rear window. Such stop lights are typically elongated and may be twenty or more inches long. In order to achieve uniform illumination over this length, neon lamps may be used. In general, neon lamps have relatively low power consumption and long operating lives.

It has proposed in the prior art to use neon lamps for signaling in vehicles. A neon lamp direction signal, including arrows for indicating direction, is disclosed in U.S. Pat. No. 1,792,599 issued Feb. 17, 1931 to Murray. The disclosed lamp also includes a stop signal indication. A neon sign, including a neon lamp tube for mounting in the window of an automobile, is disclosed in U.S. Pat. No. 1,854,654 issued Apr. 19, 1932 to Koch, Jr. et al. A neon lamp signaling device for mounting in the rear window of the vehicle is disclosed in U.S. Pat. No. 1,839,499 issued Jan. 5, 1932 to Rava. A rare gas automobile indicator light system employing a single, horizontally-disposed indicator tube operated to provide braking, parking, emergency flasher and turn indication is disclosed in U.S. Pat. No. 4,682,146 issued Jul. 21, 1987 to Friedman, III.

For efficient operation, the CHMSL should have a relatively narrow output light pattern in a plane parallel to the direction of vehicle travel, so that the stop light is clearly visible to following vehicles. Typically, the stop light is required to have an output of 16 candela or greater at 10° up from the horizontal plane, 25 candela or greater at 5° up from horizontal and 25 candela or greater at 5° down from horizontal. A lens is usually used to produce the desired light pattern.

It has been proposed to use aperture lamps in CHMSL's. In an aperture lamp, a tubular neon lamp is coated on its outside surface with a reflecting material, except for a narrow strip, or aperture, along the length of the tube. Light generated within the lamp tube is reflected, except in the region of the aperture. Thus, light is emitted from the lamp only through the aperture. Aperture lamps are widely used in xerographic applications. Fluorescent aperture lamps are disclosed, for example, in U.S. Pat. No. 3,225,241 issued Dec. 21, 1965 to Spencer et al; U.S. Pat. No. 3,012,168 issued Dec. 5, 1961 to Ray et al; U.S. Pat. No. 3,987,331 issued Oct. 19, 1976 to Schreurs; U.S. Pat. No. 3,275,872 issued Sep. 28, 1966 to Chernin et al; U.S. Pat. No. 3,115,309 issued Dec. 24, 1963 to Spencer et al; U.S. Pat. No. 3,067,351 issued Dec. 4, 1962 to Gungle et al; U.S. Pat. No. 3,717,781 issued Feb. 20, 1973 to Sadoski et al; and U.S. Pat. No. 3,886,396 issued May 27, 1975 to Hammer et al.

Aperture lamps fabricated by coating the lamp envelope with a reflective material have several drawbacks. The lamp envelope coating process is an additional step in the lamp fabrication process and adds to its cost. In addition, steps must be taken during the assembly of the aperture lamp into a lamp fixture to ensure that the aperture is accurately aligned with the optical axis of the lamp fixture. It is therefore desirable to provide lamp assemblies which overcome these drawbacks.

SUMMARY OF THE INVENTION

According to a first aspect of the invention, a lamp assembly is provided. The lamp assembly comprises a lamp capsule having a tubular lamp envelope and a reflector disposed around the lamp envelope. The reflector has a reflecting surface facing the lamp envelope. The aperture has a dimension transverse to the longitudinal axis of the lamp envelope that is less than the diameter of the lamp envelope. Preferably, the reflecting surface is a diffuse reflecting surface. The lamp capsule may comprise a low pressure discharge lamp, such as a neon lamp.

The reflecting surface may, but is not required to, substantially conform to an outside surface of the lamp envelope. The reflector may be fabricated of a plastic material, and the diffuse reflecting surface may be metallized. Typically, the reflecting surface is textured to obtain a diffuse reflecting characteristic. The lamp assembly may further include a lens positioned relative to the aperture for controlling the pattern of light emitted through the aperture.

In a first embodiment, the reflector comprises two sections fabricated of a plastic material, and the two sections are connected by an integral plastic hinge. The reflector and lamp capsule may be mounted within a housing having a lens.

In a second embodiment, the reflector comprises two sections secured around the lamp capsule by an adhesive. The reflector may define an enclosure, and the lamp enclosure may further comprise a ballast circuit electrically connected to the lamp capsule and disposed in the enclosure.

According to another aspect of the invention, a reflector for use with a lamp capsule having a tubular lamp envelope is provided. The reflector comprises a reflector body having a cavity for retaining the lamp capsule. The reflector defines an aperture for emission of light from the lamp capsule. The cavity has a diffuse reflecting surface facing the lamp capsule. The aperture has a dimension transverse to the longitudinal axis of the lamp envelope that is less than the diameter of the lamp envelope.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
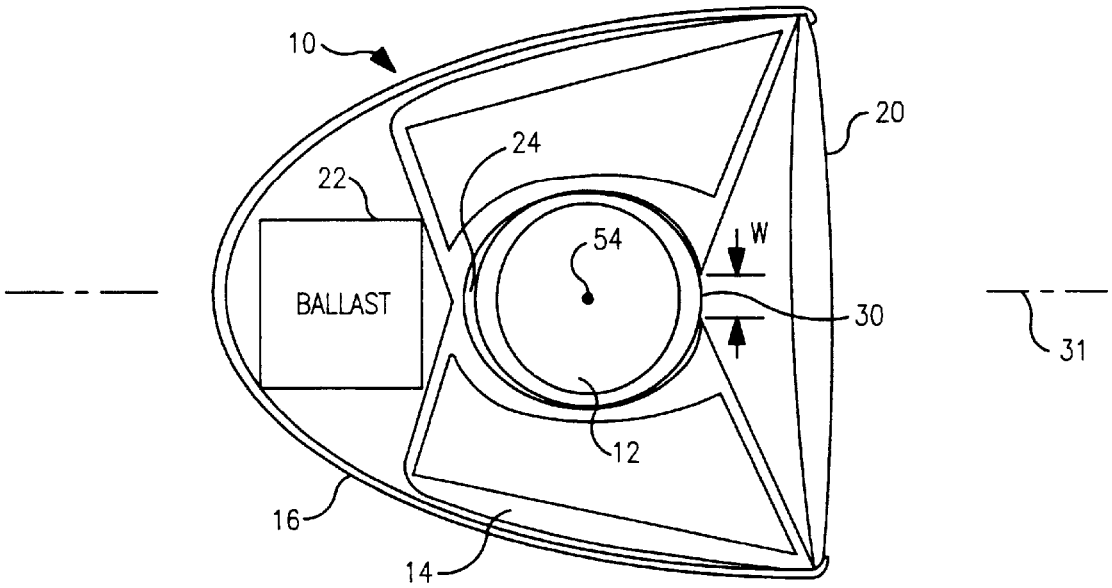
FIG. 1 is a cross section of a lamp assembly in accordance with a first embodiment of the invention.

A first embodiment of a lamp assembly in accordance with the invention is shown in FIG. 1. A lamp assembly 10 includes a lamp capsule 12 and a reflector 14. The lamp capsule 12 is typically a low pressure discharge lamp capsule and is typically tubular in shape. The lamp capsule 12 and the reflector 14 may be mounted within a housing 16 that is closed on one side by a lens 20. A ballast circuit 22 may be mounted within housing 16 and electrically connected to lamp capsule 12. The ballast circuit 22 may generate a high frequency voltage for energizing lamp capsule 12. The reflector 14 defines a cavity 24 in which lamp capsule 12 is mounted and further defines an aperture 30. As discussed below, light generated by lamp capsule 12 is emitted through aperture 30. Aperture 30 and lens 20 are positioned on an optical axis 31.

Figure 2:
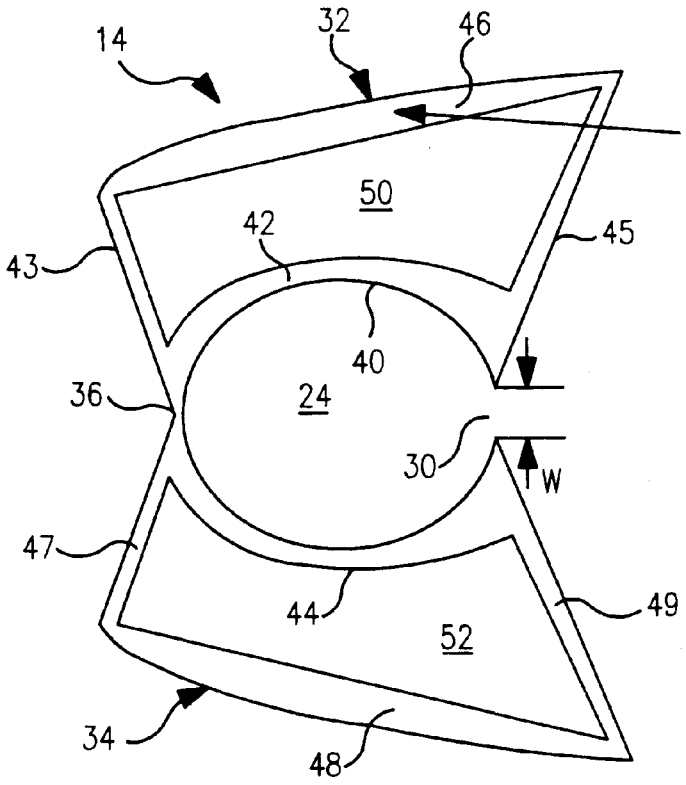
FIG. 2 is a cross sectional view of the reflector shown in FIG. 1, with the reflector in the closed position.
Figure 3:
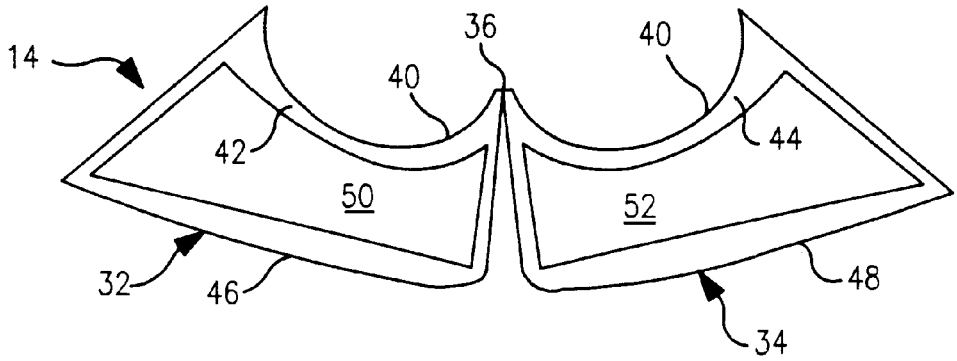
FIG. 3 is a cross sectional view of the reflector shown in FIG. 1, with the reflector in the open position.

Referring now to FIGS. 2 and 3, the reflector 14 may include a first section 32 and a second section 34. The sections 32 and 34 may be connected by a hinge 36. An inside surface 40 of cavity 24 is a reflecting surface and preferably has a diffuse reflecting characteristic. Light generated by lamp capsule 12 is reflected by reflecting surface 40 one or more times and eventually passes through aperture 30. The combination of lamp capsule 12 and reflector 14 constitutes an aperture lamp assembly which does not require masking and coating of lamp capsule 12.

The reflector 14 may be fabricated by extrusion of a plastic material such as polycarbonate. The material is selected based on its ability to withstand the operating temperature of the lamp assembly and its cost. Typically, the lamp capsule 12 may operate at about 6.0 watts, and the operating temperature is relatively low. The reflector 14 may be fabricated by extrusion to any desired length. In the example of FIGS. 1–3, the reflector 14 defines an oval cavity 24 defined by approximately C-shaped portions 42 and 44. The reflector 14 further includes outside portions 46 and 48 that are configured to match the inside contour of housing 16. Portions 42 and 46 of section 32 are joined by wall portions 43 and 45. Portions 44 and 48 of section 34 are joined by wall portions 47 and 49. A region 50 between portions 42 and 46 and a region 52 between portions 44 and 48 may be hollow for reduced material cost and reduced weight. Furthermore, the portions 46 and 48 may be omitted in applications where a smaller reflector configuration is required. It will be understood that the C-shaped portions 42 and 44 are sufficient to provide the aperture lamp configuration.

The cavity 24 may have an oval, elliptical or circular cross section, or any other cross section that provides a desired light output pattern and is reasonably matched to the lamp capsule. When the cavity 24 has an oval or elliptical cross section, surface 40 contacts lamp capsule 12 at two points, so that the diameter of the lamp capsule 12 defines the width of aperture 30. When the cavity 24 has a circular cross section, it is dimensioned slightly larger than the outside diameter of lamp capsule 12. In one example, lamp capsule 12 has an outside diameter of 5.0 millimeters (mm) and aperture 30 has a width W of 2.0 mm transverse to a longitudinal axis 54 of lamp capsule 12. Generally the width W of aperture 30 is less than the outside diameter of the lamp capsule. The aperture 30 is typically rectangular, having width W and a length determined by the length of the lamp capsule. However, the aperture may have other shapes within the scope of the present invention.

As shown in FIG. 3, reflector 14 may be opened by flexing hinge 36. The open configuration permits surface 40 to be metallized or otherwise treated to produce a desired reflectivity. In the preferred embodiment, the surface 40 is metallized by vapor deposition of an aluminum layer of thickness between 60 and 80 nanometers. The surface 40 may be textured, with surface irregularities in a range of about 10.0 micrometers to 100.0 micrometers, to provide the desired diffuse reflecting characteristic. In other embodiments, surface 40 may have a mirror-like reflecting surface.

The reflector configuration shown in FIGS. 1–3 and described above may be fabricated as a one-piece extrusion including sections 32 and 34, and integral plastic hinge 36. In other configurations, separate hinge elements may be utilized. Furthermore, separate sections, held together in the lamp assembly with an adhesive or other connecting devices, may be utilized. The two section configuration facilitates metallization of surface 40 of cavity 24.

Figure 4A:
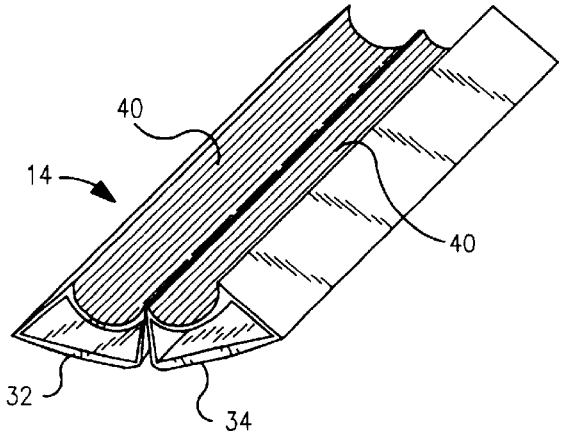
FIGS. 4A–4E are perspective views which illustrate fabrication of the lamp assembly of FIG. 1.
Figure 4B:
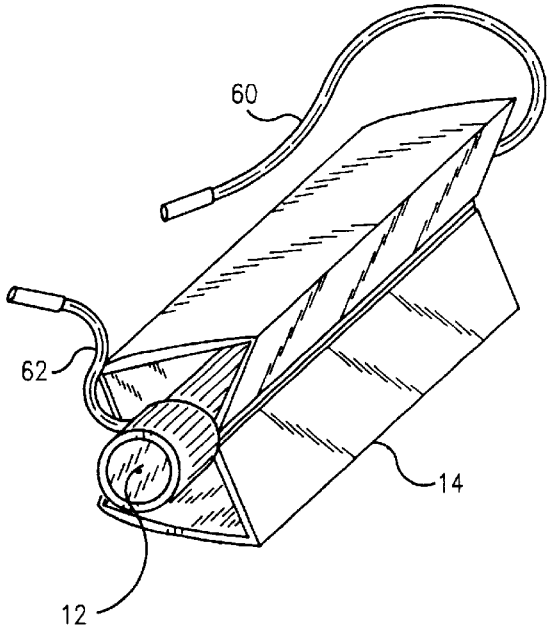
Figure 4C:
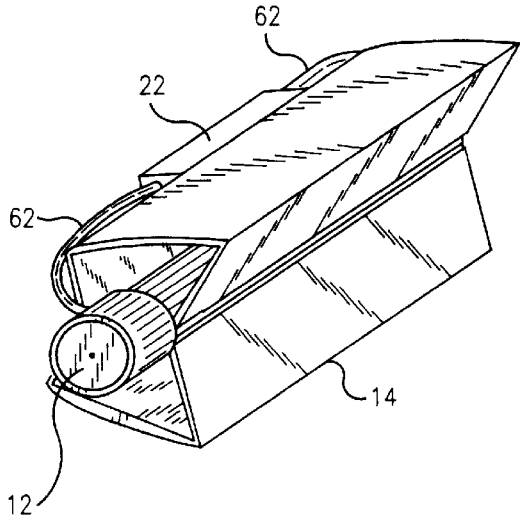
Figure 4D:
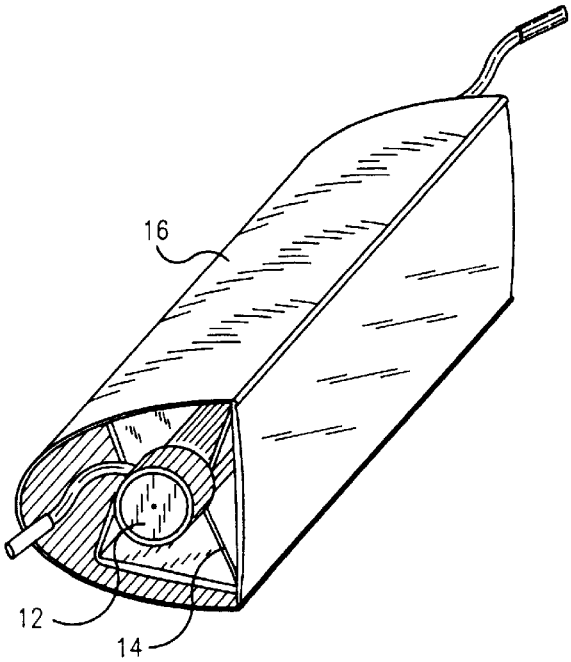
Figure 4E:
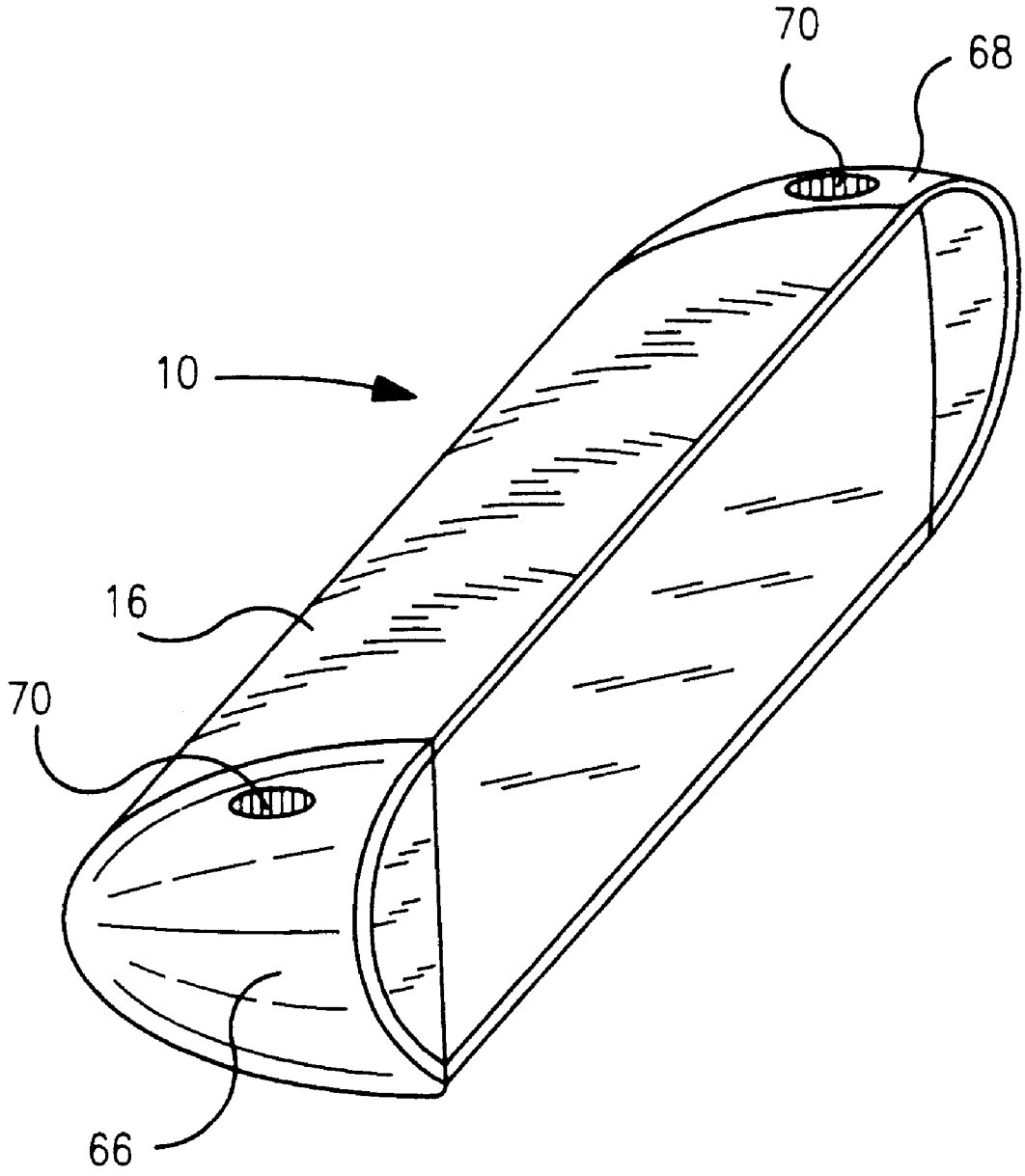

The fabrication of the lamp assembly 10 is described with reference to FIGS. 4A–4E. FIG. 4A shows the reflector 14 in the open configuration for metallization of reflecting surface 40. As shown in FIG. 4B, lamp capsule 12, having electrical leads 60 and 62 connected to opposite ends thereof, is positioned in reflector 14, and reflector 14 is closed around lamp capsule 12. As shown in FIG. 4C, ballast circuit 22 is cemented to the rear of reflector 14, and electrical leads 60 and 62 are connected to ballast circuit 22. Then, as shown in FIG. 4D, the subassembly including reflector 14, lamp capsule 12 and ballast circuit 22 is inserted into housing 16. In a preferred embodiment, the outside contours of portions 46 and 48 of reflector 14 match the inside contour of housing 16, so that housing 16 maintains reflector 14 closed around lamp capsule 12. As shown in FIG. 4E, end caps 66 and 68 are inserted into opposite ends of housing 16 to complete the lamp assembly. The end caps 66 and 68 may include holes 70 for mounting the lamp assembly 10 to the chassis or body of a vehicle.

The lamp capsule 12 may, for example be a neon lamp having an outside diameter of 5.0 mm and a length of 355.6 mm. The lamp capsule has electrodes mounted in opposite ends thereof and may include a fill material of neon at a fill pressure of about 100 Torr. Neon lamp configurations are well known to those skilled in the art. It will be understood that a variety of different lamp types and sizes may be utilized with the reflector of the present invention to provide an aperture lamp assembly. For example, the lamp capsule 12 may be a fluorescent lamp or any other low pressure discharge lamp having a generally tubular configuration. The reflector cavity and the aperture are dimensioned to receive the lamp capsule and to provide a desired light output pattern.

The aperture 30 is preferably located in the focal plane of lens 20 to provide a narrow output beam. A wide variety of lens configurations are well-known to those skilled in the art. The lens 20 may include a single element or compound elements.

Figure 5:
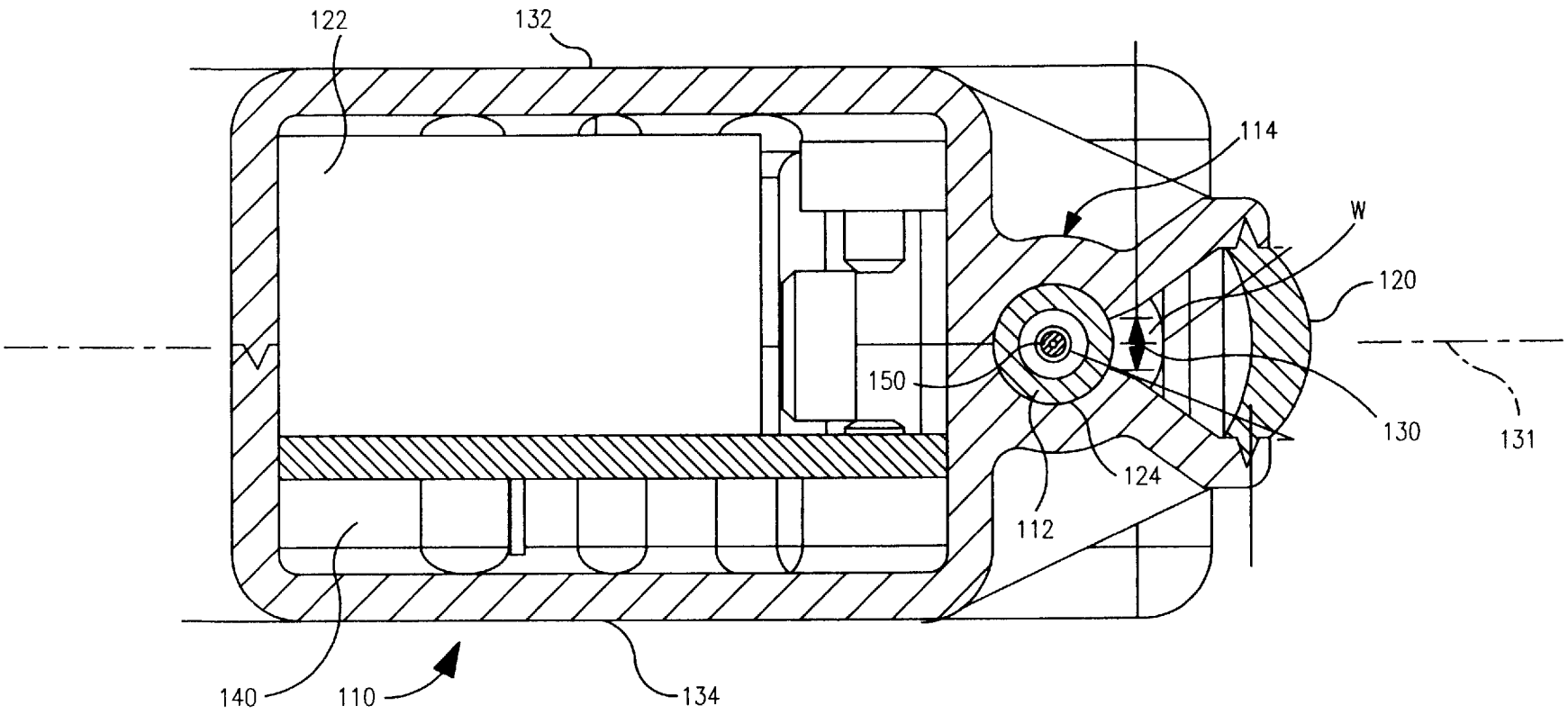
FIG. 5 is a cross sectional view of a lamp assembly in accordance with a second embodiment of the invention.

A lamp assembly in accordance with a second embodiment of the invention is shown in FIG. 5. A lamp assembly 110 includes a lamp capsule 112 mounted in a reflector 114. The reflector 114 defines a cavity 124 in which lamp capsule 112 is mounted. The cavity 124 has a tubular shape with an inside diameter that is slightly larger than the outside diameter of lamp capsule 112. The inside surface of cavity 124 has a reflecting surface as described above in connection with reflecting surface 40 of reflector 14. Reflector 114 further defines an aperture 130 for emission of light generated by lamp capsule 112. As described above, light generated by lamp capsule 112 is reflected one or more times by the surface of cavity 124 and is finally emitted through aperture 130.

In the embodiment of FIG. 5, reflector 114 includes a first section 132 and a second section 134 which may be cemented together with an adhesive. The sections 132 and 134 of reflector 114 that may, for example be injected molded of a plastic material such as polycarbonate. A lens 120 is retained by reflector 114 in alignment with aperture 130 to control the light output pattern of the lamp assembly. Aperture 130 and lens 120 are positioned on an optical axis 131.

In the embodiment of FIG. 5, reflector 114 defines an enclosure 140 for mounting a ballast circuit 122. The ballast circuit 122 is electrically connected to the electrodes of lamp capsule 112 and generates a high frequency voltage for energizing lamp capsule 112.

It will be understood that the portions of reflector 114 which define enclosure 140 and which retain lens 120 are optional within the scope of the present invention. The ballast circuit 122 and the lens 120 may be mounted separately from reflector 114. The basic elements of reflector 114 include a cavity for retaining a lamp capsule, with the inside surface of the cavity facing the lamp capsule having a reflecting surface, and an aperture for emission of light generated by the lamp capsule. The aperture 130 has a width W transverse to a longitudinal axis 150 of lamp capsule 112 (perpendicular to the plane of FIG. 5) that is less than the diameter of the lamp capsule.

Figure 6:
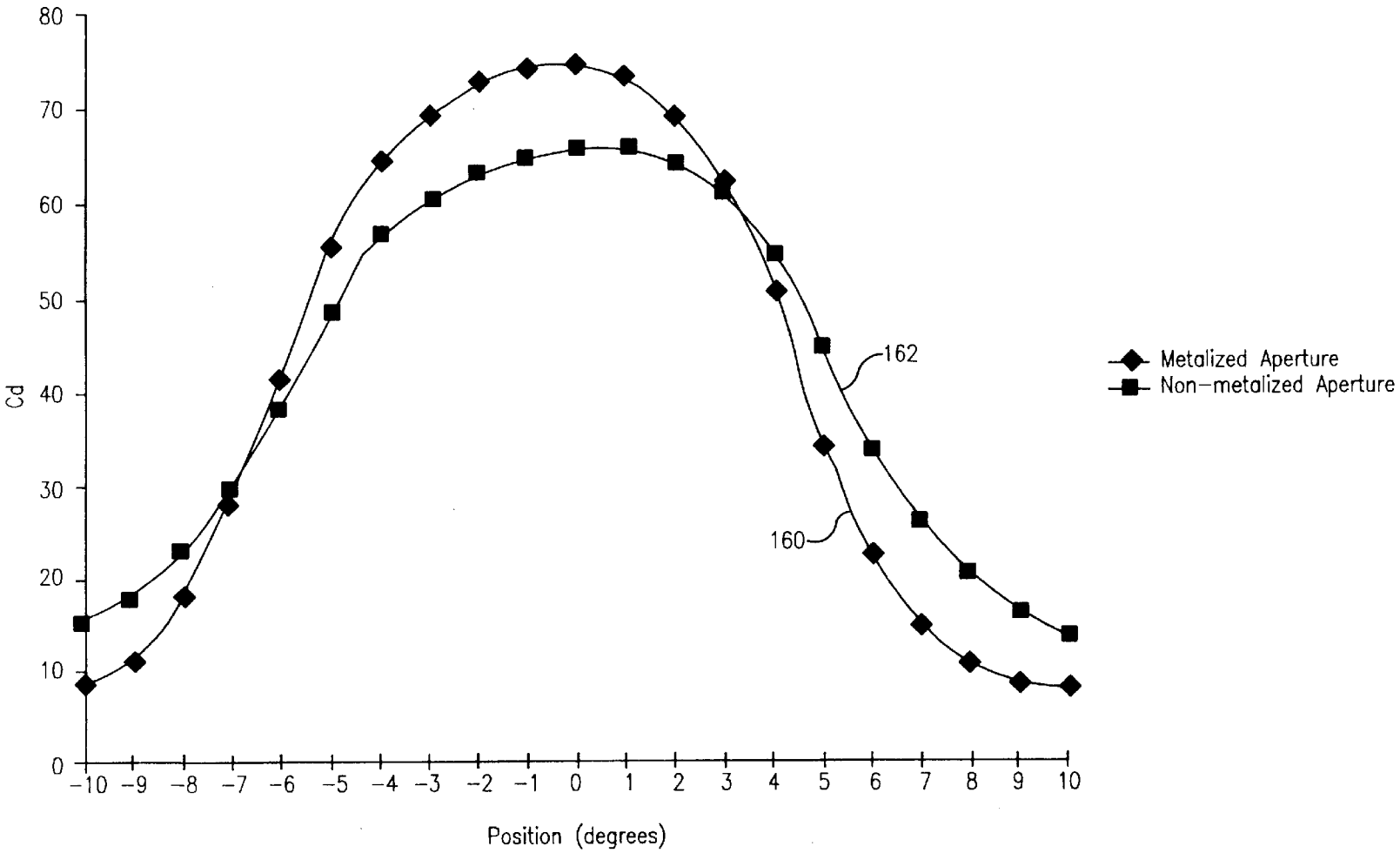
FIG. 6 is a graph of a light intensity as a function of angle for a prior art aperture lamp having a metallic coating and for a lamp assembly in accordance with the present invention.

A comparison of the light output pattern of a conventional metallized aperture lamp and a lamp assembly in accordance with the present invention is shown in FIG. 6. Output light intensity is plotted as a function of angle. Curve 160 represents the output light pattern of a conventional neon tubular lamp having a highly reflective coating on its outside surface. A 2.0 mm wide aperture was formed in the coating. The light output of the neon lamp was directed through cylindrical rod lens. Curve 162 represents light output pattern of a lamp assembly in accordance with the invention. A 2.0 mm wide aperture was formed in a stainless steel tube, and aluminum foil was placed on the inside surface of the tube, with the frosted side facing inwardly. A tubular neon lamp was placed inside the stainless steel tube. The light output of the neon lamp was directed through the aperture and a cylindrical rod lens for measurement. In each case, the neon lamp had an outside diameter of 5.0 mm and a length of 457.2 mm. The cylindrical rod lens had a diameter of 8.0 mm. FIG. 6 demonstrates that the lamp assembly of the present invention produces a broader output light pattern than the metallized aperture lamp of the prior art.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A lamp assembly comprising:

a lamp capsule having a tubular lamp envelope, said lamp envelope having a longitudinal axis and a diameter; and a reflector to enclose a portion of the tubular lamp envelope, the reflector having a first reflector portion having a wall with a reflective surface defining a first cavity with a first longitudinal extension, and a second reflector portion having a wall defining a second cavity with a second longitudinal extension generally parallel to the first longitudinal extension, the first reflector portion being flexibly coupled to the second reflector portion along a joint extending parallel to the first longitudinal extension, and parallel to the second longitudinal extension; the wall of the first reflector portion being angled to generally face the wall of the second reflector portion so that the defined first cavity and the defined second cavity together define a volume to receive a portion of the lamp envelope, and thereby enclose a portion of the lamp envelope between the first reflector portion and the second reflector portion;

the first reflector portion and the second reflector portion further defining an aperture for emission of light from said lamp capsule, said aperture having a dimension transverse to the longitudinal axis of said lamp envelope that is less than the diameter of said lamp envelope.

2. A lamp assembly as defined in claim 1 wherein said reflecting surface comprises a diffuse reflecting surface.

3. A lamp assembly as defined in claim 1 wherein said lamp capsule comprises a low pressure discharge lamp.

4. A lamp assembly as defined in claim 1 wherein said lamp capsule comprises a neon lamp.

5. A lamp assembly as defined in claim 1 wherein said aperture is linear.

6. A lamp assembly as defined in claim 5 wherein said aperture is rectangular.

7. A lamp assembly as defined in claim 1 wherein said reflecting surface substantially conforms to an outside surface of said lamp envelope.

8. A lamp assembly as defined in claim 2 wherein said reflector is fabricated of a plastic material and said diffuse reflecting surface is metallized.

9. A lamp assembly as defined in claim 8 wherein said diffuse reflecting surface is textured.

10. A lamp assembly as defined in claim 1 further including a lens positioned relative to said aperture for controlling a pattern of light emitted through said aperture.

11. A lamp assembly as defined in claim 1 wherein the first reflector portion and the second reflector portion of said reflector are secured in position around said lamp capsule by an adhesive.

12. A lamp assembly as defined in claim 1 wherein said reflector defines an enclosure and wherein said lamp assembly further comprises a ballast circuit electrically connected to said lamp capsule and disposed in said enclosure.

13. A lamp assembly as defined in claim 1 further comprising a housing defining an enclosure, said lamp capsule and said reflector being disposed in said enclosure.

14. A lamp assembly as defined in claim 13 further comprising a ballast circuit electrically connected to said lamp capsule and disposed within said enclosure.

15. A lamp assembly as defined in claim 13 wherein said housing is closed by a lens in optical alignment with said aperture, wherein light emitted through said aperture is directed through said lens.

16. A lamp assembly comprising:

a lamp capsule having a tubular lamp envelope, said lamp envelope having a longitudinal axis and a diameter; and a reflector disposed around said lamp envelope, said reflector defining an aperture for emission of light from said lamp capsule, said reflector having a reflecting surface facing said lamp envelope, said aperture having a dimension transverse to the longitudinal axis of said lamp envelope that is less than the diameter of said lamp envelope and said reflector comprises two sections disposed around said lamp capsule and the two sections of said reflector are fabricated of a plastic material and the two sections are connected by an integral plastic hinge.

17. A lamp assembly as defined in claim 16 further comprising a housing having a lens mounted therein, wherein said reflector and said lamp capsule are disposed within said housing.

18. A lamp assembly comprising:

a low pressure discharge lamp capsule having a tubular lamp envelope, said lamp envelope having a longitudinal axis and a diameter;

a reflector to enclose a portion of the tubular lamp envelope, the reflector having a first reflector portion having a wall with a reflective surface defining a first cavity with a first longitudinal extension, and a second reflector portion having a wall defining a second cavity with a second longitudinal extension generally parallel to the first longitudinal extension, the first reflector portion being flexibly coupled to the second reflector portion along a joint extending parallel to the first longitudinal extension, and parallel to the second longitudinal extension; the wall of the first reflector portion being angled to generally face the wall of the second reflector portion so that the defined first cavity and the defined second cavity together define a volume to receive a portion of the lamp envelope, and thereby enclose a portion of the lamp envelope between the first reflector portion and the second reflector portion;

the first reflector portion and the second reflector portion further defining an aperture for emission of light from said lamp capsule, said aperture having a dimension transverse to the longitudinal axis of said lamp envelope that is less than the diameter of said lamp envelope;

a ballast circuit electrically connected to said lamp capsule and disposed in said ballast circuit enclosure; and a lens positioned relative to said aperture for controlling a pattern of light emitted by said lamp capsule through said aperture.

19. A lamp assembly as defined in claim 18 wherein said lamp capsule comprises a neon lamp.

20. A lamp assembly as defined in claim 18 wherein said reflecting surface substantially conforms to an outside surface of said lamp envelope.

21. A lamp assembly as defined in claim 18 wherein said reflector is fabricated of a plastic material and said diffuse reflecting surface is metallized.

22. A lamp assembly as defined in claim 21 wherein said diffuse reflecting surface is textured.

23. A lamp assembly as defined in claim 18 wherein said first reflector portion and said second reflector portion are disposed around said lamp capsule and secured in position around said lamp capsule by an adhesive.

24. A reflector for use with a lamp capsule having a tubular lamp envelope, the lamp envelope having a longitudinal axis and a diameter, said reflector comprising;

a first reflector portion having a wall with a reflective surface defining a first cavity with a first longitudinal extension, and a second reflector portion having a wall defining a second cavity with a second longitudinal extension generally parallel to the first longitudinal extension, the first reflector portion being flexibly coupled to the second reflector portion along a joint extending parallel to the first longitudinal extension, and parallel to the second longitudinal extension; the wall of the first reflector portion being angled to generally face the wall of the second reflector portion so that the defined first cavity and the defined second cavity together define a volume to receive a portion of the lamp envelope, and thereby enclose a portion of the lamp envelope between the first reflector portion and the second reflector portion; and the first reflector portion and the second reflector portion further defining an aperture for emission of light from said lamp capsule.

25. A reflector as defined in claim 24 wherein said aperture is rectangular.

26. A reflector as defined in claim 24 wherein said reflector body is fabricated of a plastic material and said diffuse reflecting surface is metallized.

27. A reflector as defined in claim 26 wherein said diffuse reflecting surface is textured.

28. A reflector for use with a lamp capsule having a tubular lamp envelope, the lamp envelope having a longitudinal axis and a diameter, said reflector comprising;

a reflector body having a cavity for retaining the lamp capsule and defining an aperture for emission of light from said lamp capsule, said cavity having a diffuse reflecting surface facing the lamp capsule, said aperture having a dimension transverse to the longitudinal axis of the lamp envelope that is less than the diameter of the lamp envelope said reflector body comprises two sections, the two sections of said reflector body are fabricated of a plastic material and the two sections are connected by an integral plastic hinge.

* * * * *